US006300851B1

(12) United States Patent
Baur et al.

(10) Patent No.: US 6,300,851 B1
(45) Date of Patent: Oct. 9, 2001

(54) ELECTROMAGNET SYSTEM AND METHOD FOR ASSEMBLING A CORE AND A YOKE IN SUCH A SYSTEM

(75) Inventors: Rudolf Baur, Evora (PT); Horst Hendel, Berlin (DE)

(73) Assignee: Tyco Electronics Logistics AG, Steinrich (CH)

( * ) Notice: Subject to any disclaimer, the term of this patent is extended or adjusted under 35 U.S.C. 154(b) by 0 days.

(21) Appl. No.: 09/445,707

(22) PCT Filed: May 20, 1998

(86) PCT No.: PCT/DE98/01386

§ 371 Date: Dec. 9, 1999

§ 102(e) Date: Dec. 9, 1999

(87) PCT Pub. No.: WO98/59351

PCT Pub. Date: Dec. 30, 1998

(30) Foreign Application Priority Data

Jun. 19, 1997 (DE) ..... 197 26 055

(51) Int. Cl.[7] ..... H01F 7/10; H01H 67/02

(52) U.S. Cl. ..... 335/128; 335/250

(58) Field of Search ..... 335/78–86, 124, 335/128, 250, 251, 252

(56) References Cited

U.S. PATENT DOCUMENTS

| | | | | |
|---|---|---|---|---|
| 3,209,294 | | 9/1965 | Cornell . | |
| 4,720,909 | | 1/1988 | Knight et al. . | |
| 5,311,162 | * | 5/1994 | Sjoquist et al. | 335/260 |
| 5,332,985 | * | 7/1994 | Hendel | 335/78 |
| 5,519,369 | * | 5/1996 | Hendel | 335/85 |

FOREIGN PATENT DOCUMENTS

| | | | |
|---|---|---|---|
| 31 48 052 A1 | | 12/1981 | (DE) . |
| 0 593 517 B1 | | 6/1992 | (EP) . |
| 9-17312 | * | 6/1995 | (JP) . |
| PCT/DE92/00512 | | 6/1922 | (WO) . |

* cited by examiner

*Primary Examiner*—Lincoln Donovan
(74) *Attorney, Agent, or Firm*—Schiff Hardin & Waite

(57) ABSTRACT

The electromagnet system has a yoke (1) and a round core 92) that has a cylindrical shaft and an outwardly expanded cone section (25) toward the fastening end. The core has its shaft plugged in advance into a round hole (13) of the yoke proceeding from the outside. The cone section (25) of the core also has a thread with which it is turned into the thread-free round hole (13) of the yoke (1) by being turned. In this way, the core can be exactly positioned and a good interference fit and a good magnetic coupling are achieved.

11 Claims, 2 Drawing Sheets

ELECTROMAGNET SYSTEM AND METHOD FOR ASSEMBLING A CORE AND A YOKE IN SUCH A SYSTEM

FIELD OF THE INVENTION

The invention is directed to an electromagnet system with a yoke and a core that has a fastening end secured in a round hole of a yoke section, whereby the core comprises a preferably cylindrical shaft and a conical section at its fastening end, this latter having a core diameter exceeding the diameter of the round hole penetrating the material of the yoke. The invention is also directed to a method for joining core and yoke given such a system.

BACKGROUND OF THE INVENTION

EP 0 593 517 B1 discloses an electromagnet system of the species initially cited wherein the core has its cylindrical shaft plugged through a round hole of the yoke leg proceeding from the outside and has the core section of its end side clamped in a bore of the yoke leg. For clamping and for setting the final position, the core is thereby charged with pulse-like impacts. Although a good interference seat of the core derives in this way, the pulse-like impacts can produce undesired jolts and friction at other elements connected to the magnet system, for example at contacts. Moreover, the adjustment of the core therein is possible only in one direction, namely in the direction of the core insertion.

DE 31 48 052 A1 also already discloses an electromagnetic relay whose coil core is secured with a fine thread in a bore likewise correspondingly provided with a fine thread, being secured and adjusted by being screwed in. This exact screw connection, however, not only requires complicated manufacture and assembly of the parts but it by itself also does not produce an adequate interference fit, so that additional fixing means are required. For example, it is thus proposed to apply a plastic adhesive onto the fine thread or to provide the core with an additional counternut for securing. This requires an additional outlay; further, the fixing agent in the thread can deteriorate the magnetic coupling, whereas the additional counter-nut also requires additional space.

An object of the invention is to improve an electromagnet system of the species initially cited such that a good and dependable connection and magnetic coupling of core and yoke is achieved in a simple way, whereby this connection should be capable of being exactly adjusted - namely both forward as well as backward.

This object is inventively achieved in that a thread is fashioned on the conical section of the core, said thread being turned self-deforming into the inherently thread-free wall of the likewise conically expanded recess of the yoke.

Given the inventive magnetic system, thus, the conical section of the core and the conical inside wall of the round hole in the yoke section are already matched to one another. The ultimate fastening in one another and the fine positioning, however, ensue by turning via the thread fashioned on the cone section of the core, this digging into the smooth inside surface of the round hole when turned in. It is comparatively simple to manufacture this one thread on the core since a mating with a correspondingly prefabricated, complementary nut thread in the yoke is not required. Due to the displacement of the material when the thread core is screwed into the yoke section, an excellent interference seat as well as a good magnetic coupling between these two parts derive without auxiliary measures. An especially good coupling derives when the thread on the core is fashioned as flat thread, (i.e. when the individual turns of the thread channel or, respectively, of the thread channels given multiple-start threads) exhibit a large spacing in relationship to the channel depth, so that a flattened thread web arises that is trapezoidal in cross section or approximately saw-tooth-shaped given a sidewall that is steeper at one side.

The cone section of the core and the conical inside wall of the round hole in the yoke can, for example, have an angle between 0.5 °and 5° relative to the core axis. However, an angle similar to conical sleeves and conical shafts for self-locking tool fastening is preferably selected. The angle of the cone envelope relative to the axis thereby lies between 1° and 2°, preferably at approximately 1.5° (1° 30 minutes) or, respectively, between 1° 25 minutes and 1° 30 minutes in what is referred to as a Morse cone. Given this slight slope angle, it would also be conceivable to fashion that shaft of the core with the fastening section continuously slightly conically (with approximately 1° slope). The thread can be especially simply produced on the cone section when the thread channel or, respectively, thread channels exhibits (or, respectively, exhibit) a constant inside core diameter. This means that the thread has not been or has only been slightly dug in at the narrowest location of the cone section wherein it is cut in deeper and deeper toward the broadened end. An especially simple manufacture and processing derives given fashioning as rolling thread.

For improving the magnetic properties, both the yoke as well as the core are expediently soft-annealed. The soft-annealed yoke also has the advantage that it easily widens or, respectively, deforms when the threaded core is turned in, that excessively high torques are not required. It is advantageous at the core when it is annealed before the thread is rolled on, since the warp at the thread walls produced by material displacement when rolling the thread experiences a certain hardening and thus digs more easily into the soft-annealed, thread-free material of the round hole when the core is turned in.

Moreover, a surface coating of copper or copper-graphite can facilitate the turning and prevent ceasing. This can ensue nearly without additional outlay since a coating, for example with Cu, is desirable anyway as corrosion protection. The thread proceeds partly only in the coating, which serves as a type of lubrication.

An inventive method for joining core and yoke in the inventive electromagnet system comprises essentially the following steps:

- producing a conical round hole in the yoke section;
- producing a core with a cylindrical shaft and a cone section at one end of the core that expands toward the free end;
- producing a thread on the cone section;
- plugging the cylindrical shaft of the core through the round hole of the yoke section until the cone section clamps in the round hole; and
- turning the core in thread direction upon application of an axial force until the free end of the cylindrical shaft has reached a predetermined position.

In an embodiment, the present invention provides an electromagnet system comprising a yoke comprising a transverse section having a round hole; and a core comprising a fastening end secured in a the round hole the transverse section of the yoke, the core further comprising a cylindrical shaft connected to a conical section which is connected to the fastening end of the core, at least a portion of the conical section being larger in diameter than the round hole, the conical section further comprising a threaded section that extends to the fastening end, the threaded section of the conical section of the core engaging the round hole of the transverse section of the yoke.

In an embodiment, the conical section of the core expands conically in diameter as the conical section extends from the cylindrical shaft towards the fastening end.

In an embodiment, the threaded section on the conical section of the core comprises a flattened thread web.

In an embodiment, the thread web comprises a trapezoidal cross section.

In an embodiment, the thread web comprises a saw tooth-shaped cross section.

In an embodiment, the conical section of the core has an outer surface and a central axis and a slope angle of its outer surface relative to its central axis ranging from 0.5° to 5°.

In an embodiment, the slope angle ranges from 1° to 2°

In an embodiment, the slope angle is about 1.5°.

In an embodiment, the threaded section comprises a thread channel, the thread channel having a constant diameter throughout the threaded section.

In an embodiment, the threaded section comprises a rolled thread.

In an embodiment, the yoke and the core are soft-annealed.

In an embodiment, the fastening end comprises an axial prismatic recess for receiving a rotating tool.

In an embodiment, the present invention provides a method for joining a core and a yoke in an electromagnet system, the method comprising the following steps: providing a yoke; producing a conical round hole in the yoke; manufacturing a core with a cylindrical shaft connected to a conical section that expands in diameter as it extends from the cylindrical shaft towards a fastening end of the core, the cylindrical shaft comprising a free end; producing a thread on the conical section; inserting the cylindrical shaft of the core through the round hole of the yoke section until the conical section engages the round hole; and rotating the core while applying an axial force towards the round hole until a free end of the cylindrical shaft has reached a predetermined position.

In an embodiment, the step of producing the conical round hole comprises punching the hole through the yoke with a conical pin.

In an embodiment, the step of producing the thread comprises using a rolling process.

In an embodiment, the step of producing the conical round hole in the yoke comprises soft-annealing the yoke after the production of the conical round hole.

In an embodiment, the step of producing the core comprises soft-annealing the core before the step of producing the thread on the conical section of the core.

Other objects and advantages of the present invention will become apparent from reading the following detailed description and appended claims, and upon reference to the accompanying drawings.

BRIEF DESCRIPTION OF THE DRAWINGS

The invention is explained in greater detail below with reference to an exemplary embodiment on the basis of the drawings. Wherein.

It should be understood that the drawings are not necessarily to scale and that the embodiments are sometimes illustrated by graphic symbols, phantom lines, diagrammatic representations and fragmentary views. In certain instances, details which are not necessary for and understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
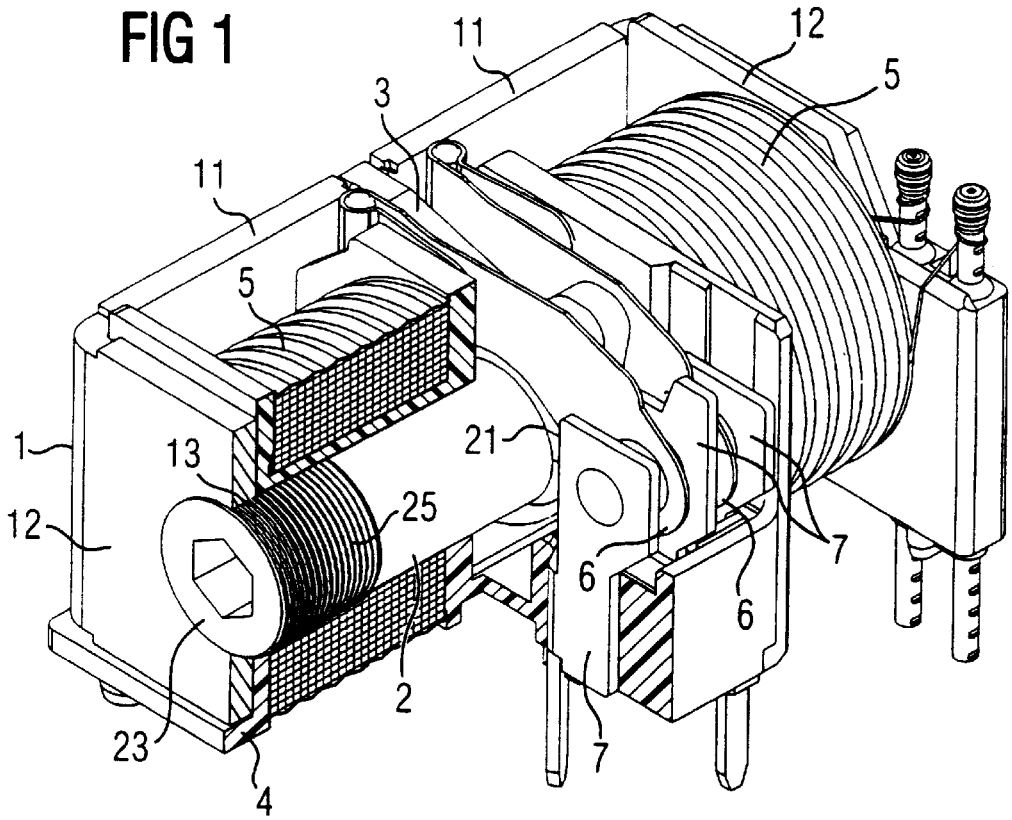
FIG. 1 a double relay with two coupled, inventive magnet systems.

The double relay shown in FIG. 1 has two magnet systems each having a respective yoke 1 that has a longitudinal section 11 and a transverse section 12. A core to having a round cross section is secured in each of the transverse yoke sections 12, this core 2 to be described in detail later. Each of these cores 2 has a pole end 21 having a pole surface 22 that forms a working air gap together with an armature 3. In the example of a double relay shown in FIG. 1, the two longitudinal yoke legs 11 are connected to one another of one piece, and the shared armature 3 interacts with the two cores 2 in alternation. It follows from this example that, in such a case, the core can only be mounted by being plugged from the outside through the yoke leg 12. Otherwise, however, the invention could also be applied in the same way for a simple relay having only one yoke and one core.

In a known way, the illustrated double relay also has a coil body 4 as carrier for two windings 5 as well as contact springs 6 and fixed contacts 7. This relay structure is known in and of itself and need not be discussed in greater detail in conjunction with the present invention.

The coil core 2 has a respective fastening end 23 secured in a round hole 13 of the transverse yoke leg 12. This round hole 13 is conically expanded from inside toward outside (from the coil) in adaptation to the core 2 and is matched to the diameter of the core such that the penetration described below yields a good interference seat and a good magnetic coupling.

Figure 2:
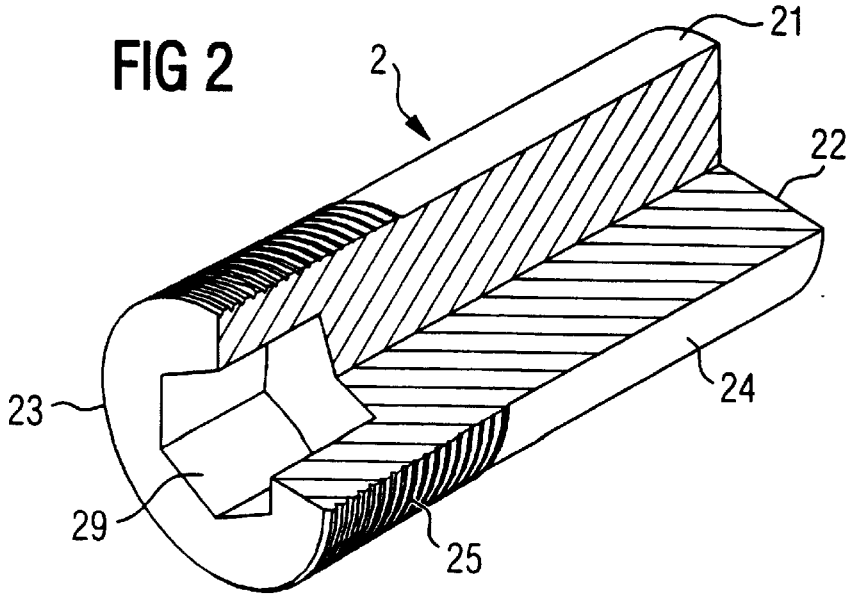
FIG. 2 is a partial perspective view of the core shown in FIG. 1.
Figure 3:
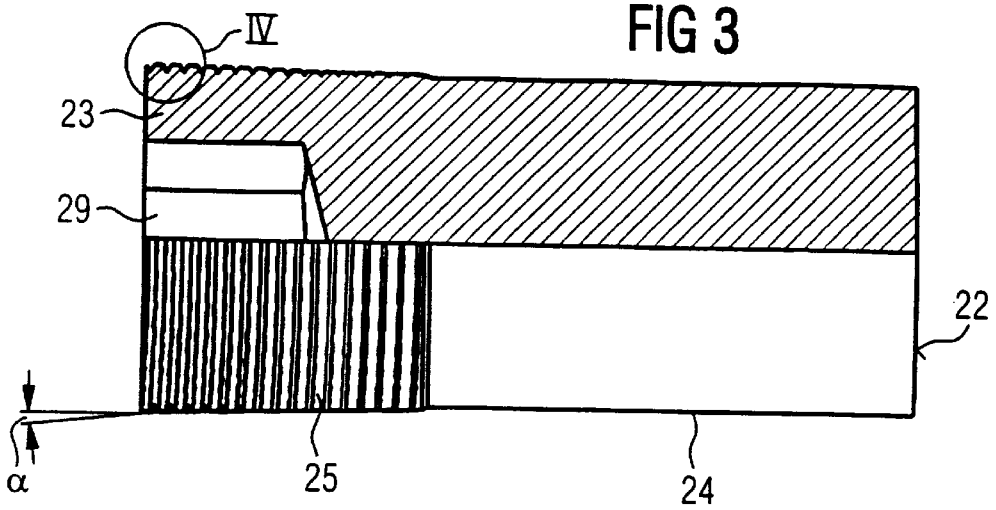
FIG. 3 is a sectional view of the core shown in FIG. 1.
Figure 4:
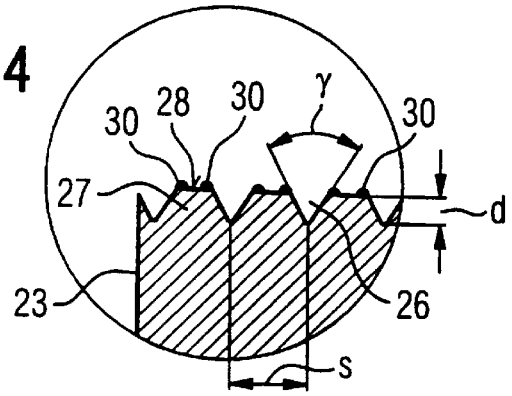
FIG. 4 is an enlarged detail excerpt IV from FIG. 3.
Figure 5:
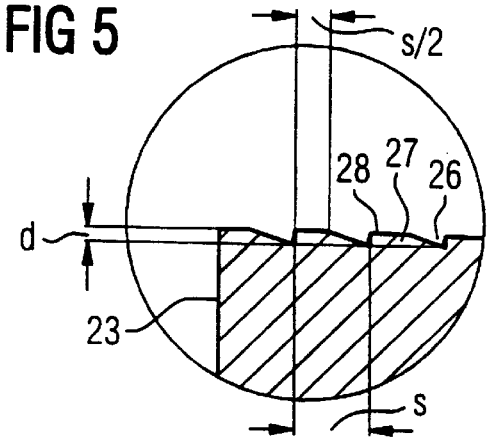
FIG. 5 is the same excerpt as FIG. 4 but with a modified thread shape.

According to FIGS. 2 and 3, the core 2 has a cylindrical shaft 24 whose diameter is somewhat smaller than the narrowest diameter of the round hole 13, so that it can be easily plugged into the coil from the outside through the yoke section 12. The core 2 also has a cone section 25 that conically expands toward the fastening end 23. Toward the end, the pitch exhibits an angle $\alpha$ relative to the axis of the core that can lie approximately between 0.5° and 5°. Preferably, however, this angle—as already mentioned—will lie between 1° and 2°. The round hole 13, moreover, comprises approximately the same, pitch. Whereas, however, the inside surface of the round hole 13 is kept smooth, a rolling thread is fashioned on the thread section 25, the thread web 27 thereof comprising a flattened upper side. This can be clearly seen in FIG. 4, which shows an enlarged illustrated of the detail IV in FIG. 3. It can be seen therefrom, that the depth of the thread channel 26 is so slight compared to the thread slope s (given a single-pitch thread) that the thread web 27 comprises a flattened upper side 28, i.e. exhibits a trapezoidal cross section according to FIG. 4. The inside diameter of the thread is preferably kept smooth for manufacturing reasons, so that the thread channel 26 does not dig into the surface or digs only slightly into the surface at the beginning of the cone section 25—i.e., at the smallest diameter thereof—, whereas this channel becomes deeper and deeper toward the end 23. Instead of the illustrated, single-pitch thread, a multi-pitch thread could also be provided. According to FIG. 4, the thread channel 26 has an aperture angle γ of approximately 60°, whereby the width of the surface 28 of the thread web 27 (in the proximity of the end 23) amounts to approximately half the slope s. However, other relationships are also possible. For example, as shown in the modification according to FIG. 5, a thread cross section in the form of a flattened saw tooth can be provided. In this case, too, the thread web 27 has a flattened upper side 28 that, for example, again exhibits a width in the proximity of the end 23 that corresponds to approximately half the thread slope s. In the region of the smaller cone diameter, of course, the thread web is even wider, since the thread channel exhibits less of a depth d thereat. For turning the core 2 into the round hole 13, a hexagonal recess is centrally applied proceeding from the fastening end 23, this enabling the placement of a turning tool. Of course, some other, arbitrary shape that enables the placement of a screwing tool could also be selected instead of the hexagon.

Given manufacture of the magnet system, the round hole 13 is preferably first pre-shaped by a punch needle and is subsequently calibrated with a conical pin for forming a conical expansion. The yoke is subsequently soft-annealed in order to generate uniform magnetic properties and to prescribe a certain yield when turning the core in.

In a standard way, the core is manufactured with the cylindrical shaft 24 and the cone projection 25 as well as the hexagonal recess 29. It is then likewise soft annealed and subsequently conducted through a thread rolling device, where the flat thread that has already been described is rolled onto the cone section 25. As a result of the rolling process, small warps 30 arise at the sidewalls of the thread web 27 due to material displacement. These warps 30 experience a slight hardening and thereby improve the penetration of the thread into the thread-free, inside surface of the round hole 13 when the core is turned in.

The core 2 that has been prepared in this way is, as already mentioned, plugged through the round hole 13 from the outside until the cone section 25 has its thread ceasing in the round hole 13. Subsequently, it is turned farther in with a suitable turning tool and upon application of a certain axial force, whereby the thread digs into the material of the yoke. By being turned, the core can thus be very exactly positioned in axial direction relative to the armature, whereby the thread also enables a certain backward adjustment by reverse turning. In any case, a good interference fit of the core in the yoke and a good magnetic coupling between the core and the yoke are assured in this way.

From the above description, it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed is:

1. An electromagnet system comprising:

a yoke having a transverse section with a round hole therein with a conically tapered entrance with a smooth surface;

a core inserted in the round hole of the transverse section of the yoke the core having a core body comprising an integrally formed cylindrical shaft and fastening end, said fastening end having an outwardly conical section, at least a portion of the conical section being larger in diameter than the round hole, the conical section being threaded and engaging the smooth surface of the entrance of the round hole of the transverse section of the yoke.

2. The electromagnet system of claim 1 wherein the threaded section on the conical section of the core comprises a flattened thread web.

3. The electromagnet system of claim 2 wherein the thread web comprises a trapezoidal cross section.

4. The electromagnet system of claim 2 wherein the thread web comprises a saw tooth-shaped cross section.

5. The electromagnet system of one of the 1 wherein the conical section of the core has an outer surface and a central axis and a slope angle of its outer surface relative to its central axis ranging from 0.50° to 5°.

6. The electromagnet system of claim 5 wherein the slope angle ranges from 1° to 2°.

7. The electromagnet system of claim 5 wherein the slope angle is about 1.5°.

8. The electromagnet system of claim 1 wherein the threaded section comprises a thread channel, the thread channel having a constant diameter throughout the threaded section.

9. The electromagnet system of claim 1 wherein the threaded section comprises a rolled thread.

10. The electromagnet system of claim 1 wherein the yoke and the core are soft-annealed.

11. The electromagnet system of claim 1 wherein the fastening end comprises an axial prismatic recess for receiving a rotating tool.

* * * * *